US010301848B2

(12) United States Patent
Diesing

(10) Patent No.: US 10,301,848 B2
(45) Date of Patent: May 28, 2019

(54) LOCKING BRACKET FOR SECURING A GATE TO A FENCE POST

(71) Applicant: ABUS August Bremicker Söhne KG, Wetter-Volmarstein (DE)

(72) Inventor: Michael Diesing, Wetter (DE)

(73) Assignee: ABUS AUGUST BREMICKER SÖHNE KG, Wetter-Volmarstein (DE)

( * ) Notice: Subject to any disclaimer, the term of this patent is extended or adjusted under 35 U.S.C. 154(b) by 0 days.

(21) Appl. No.: 15/874,142

(22) Filed: Jan. 18, 2018

(65) Prior Publication Data

US 2018/0202196 A1 Jul. 19, 2018

(30) Foreign Application Priority Data

Jan. 19, 2017 (DE) ..... 10 2017 101 029

(51) Int. Cl.
*E05B 65/00* (2006.01)
*E05B 67/38* (2006.01)
*E05C 19/18* (2006.01)

(52) U.S. Cl.
CPC ..... *E05B 65/0007* (2013.01); *E05B 67/383* (2013.01); *E05C 19/18* (2013.01); *E05C 19/188* (2013.01)

(58) Field of Classification Search
CPC .... E05B 65/0007; E05B 67/383; E05B 67/38; E05C 19/18; E05C 19/188; E05C 19/184; E05C 19/186
USPC ..... 70/14, 18, 19, 54–56, 58, 417, DIG. 43, 70/DIG. 56, 2, 3, 6, 59–61, 177, 180;
(Continued)

(56) References Cited

U.S. PATENT DOCUMENTS 966,339 A 8/1910 Leppzer
3,460,861 A * 8/1969 Niilola ..... E05B 67/383 292/281

(Continued)

FOREIGN PATENT DOCUMENTS

DE 38 16 765 A1 1/1989
FR 1050698 A 1/1954

(Continued)

OTHER PUBLICATIONS

"Gate Keeper Clamp." *Drlock*, Sep. 15, 2016, www.drlock.com/au/store/not-sold-discontinued/fence-gate-clam-lock--gate+lock-heavy+duty+gate-construction+site+lock-gate-gate+padlock+-.

*Primary Examiner* — Lloyd A Gall
(74) *Attorney, Agent, or Firm* — Harness, Dickey & Pierce, P.L.C.

(57) ABSTRACT

The present disclosure relates to a locking bracket for securing two adjacent bodies to one another, in particular for securing a gate to a fence post. The locking bracket comprises a first hoop and a second hoop that, together with the first hoop, surrounds a region for receiving the two adjacent bodies. The hoops respectively have a first end and a second end, wherein they are connected to one another in an articulated manner at their first ends so that the hoops can be pivoted between an open position in which the locking bracket can be arranged around the two adjacent bodies and a closed position in which the hoops together surround the region for receiving the two adjacent bodies. Each of the hoops forms a lug at their free ends, the lug being oriented substantially perpendicular to the second end and having at least one bore.

9 Claims, 1 Drawing Sheet

(58) Field of Classification Search
USPC ..... 292/DIG. 13, 205, DIG. 32, 256, 258, 292/281–288
See application file for complete search history.

(56) References Cited

U.S. PATENT DOCUMENTS 3,652,114 A * 3/1972 Cady ..... E05B 67/38 292/281
3,858,923 A * 1/1975 Bunn ..... E05B 67/383 292/281
3,976,315 A 8/1976 Braun
4,216,665 A 8/1980 McKelvey
4,300,373 A * 11/1981 Camos ..... E21B 33/03 166/113
4,548,058 A 10/1985 Bahry et al.
4,745,783 A * 5/1988 Poe ..... E05B 67/383 292/281
4,788,836 A * 12/1988 Poe ..... E05B 67/383 292/281
4,803,857 A 2/1989 Hall et al.
4,949,560 A 8/1990 Anderson
4,961,329 A * 10/1990 Anderson ..... E05B 67/383 70/2
5,016,928 A 5/1991 Segovia
5,174,135 A * 12/1992 Loughlin ..... E05B 67/38 292/281
5,544,505 A * 8/1996 McIntosh ..... E05B 67/383 70/14
5,746,074 A * 5/1998 Collins ..... A01D 34/828 70/14
6,092,402 A * 7/2000 Porcelli ..... A63C 11/005 70/18
6,990,839 B1 1/2006 Childres et al.
7,096,696 B2 * 8/2006 Devecki ..... B63C 11/02 70/18
7,360,380 B2 * 4/2008 Van Handel ..... A45C 13/1084 211/9
8,020,414 B2 9/2011 Pitisethakarn
8,739,582 B2 * 6/2014 Diesing ..... E05B 67/38 70/416
8,800,329 B1 * 8/2014 Dolev ..... E05B 67/36 70/290
8,820,125 B1 * 9/2014 Dolev ..... E05B 67/02 70/38 A
8,839,649 B1 * 9/2014 Miller ..... H01H 9/282 70/14
9,512,640 B2 * 12/2016 Kyllonen ..... E05B 67/38
2002/0139153 A1 * 10/2002 Tsai ..... B62H 5/003 70/18
2004/0107744 A1 * 6/2004 Chen ..... E05B 65/48 70/2
2007/0234764 A1 * 10/2007 Weinberger ..... E05B 67/36 70/2
2008/0264116 A1 10/2008 McNeil
2009/0199602 A1 * 8/2009 Diesing ..... E05B 67/38 70/55

FOREIGN PATENT DOCUMENTS

JP 2003-284229 A 10/2003
WO WO-83/01646 A1 5/1983
WO WO-93/22534 A1 11/1993

* cited by examiner

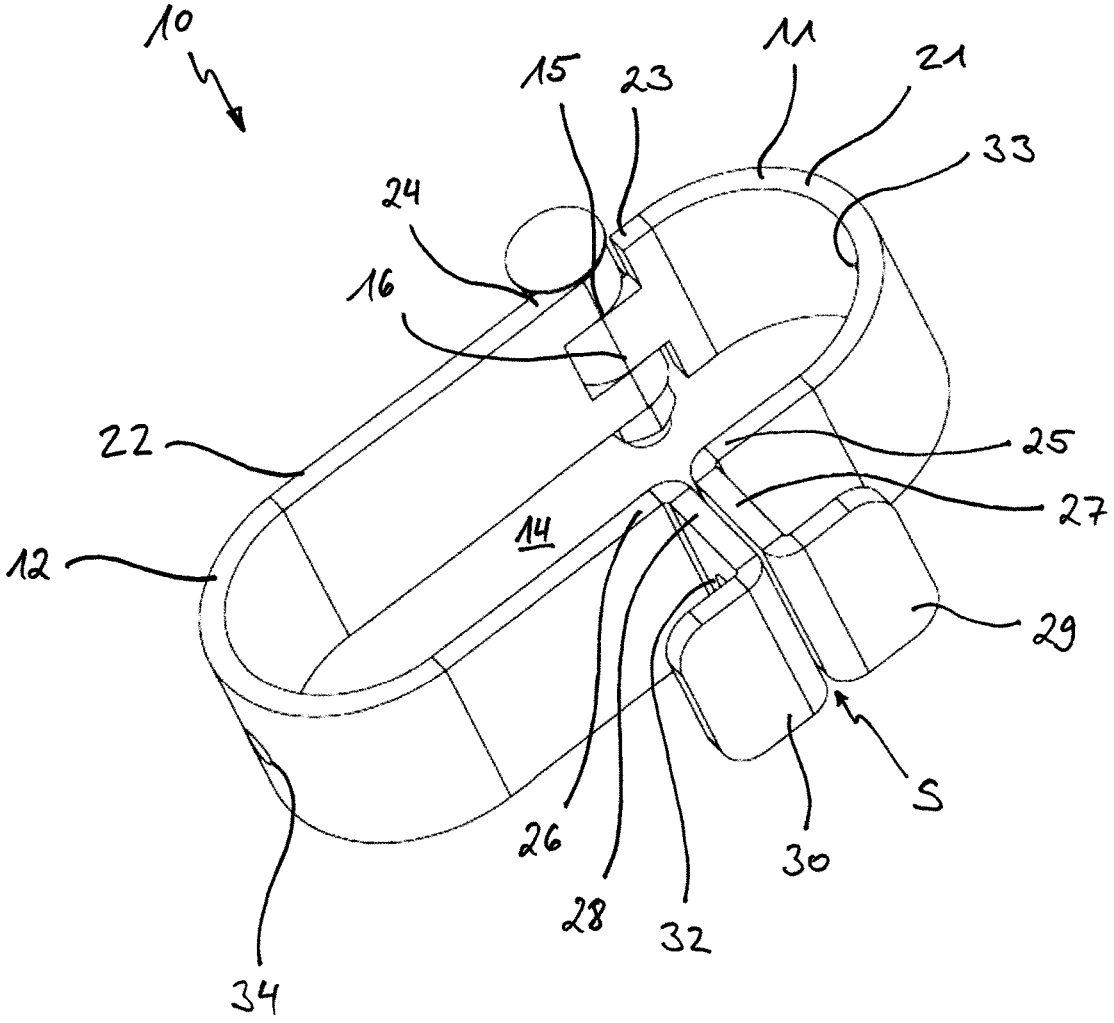
10
15
23
11
21
33
24
16
22
25
27
14
12
29
S
26
30
28
32
34

LOCKING BRACKET FOR SECURING A GATE TO A FENCE POST

CROSS-REFERENCE TO RELATED APPLICATIONS

This application claims the benefit and priority of German application number 10 2017 101 029.7 filed Jan. 19, 2017. The entire disclosure of the above application is incorporated herein by reference.

FIELD

The present invention relates to a securing bracket for securing two adjacent bodies to one another and in particular to a locking bracket by which, for example, a gate or a swing gate can be secured to a fence post, for example of a pasture fence, or, for example, to another gate or gate leaf.

BACKGROUND

Entrance gates or sliding doors with a round section and swing gates or gates of pasture fences are frequently secured with the aid of link chains in that such a link chain is wound around the gate and an adjacent post and the chain is subsequently secured by a padlock. Although such link chains can be produced from hardened steel, they can nevertheless be destroyed or broken open by the effect of mechanical force with the aid of bolt cutters, saws, crowbars, files or the like. Padlocks can likewise be broken open by the effect of force with the aid of corresponding tools even if the closing hoop consists of hardened steel.

Furthermore, to secure two adjacent bodies to one another such as to secure a gate to a fence post, a locking bracket can be used that has two hoops that are connected in an articulated manner and that together surround a region in their interior for receiving the two adjacent bodies. A respective metal sheet that has a hole for receiving a closing hoop of a padlock is welded to each of the hoops in the vicinity of their free ends. The metal sheets are oriented and are easily accessible from the outside in this respect such that the metal sheets can be manipulated by the effect of mechanical force, which has the consequence that the respective weld seam breaks or tears.

SUMMARY

It is the underlying object of the invention to provide a latching apparatus with which two adjacent bodies can be secured to one another, for example a gate to a fence post, wherein the apparatus should be as stable as possible in order to also be able to withstand the effect of mechanical force.

This object is satisfied in accordance with the invention by a locking bracket for securing two adjacent bodies to one another, in particular for securing a gate to a fence post, that as a first hoop and a second hoop that, together with the first hoop, surrounds a region for receiving the two adjacent bodies, wherein the hoops respectively have a first end and a second end and are connected to one another in an articulated manner at their first ends such that the hoops are pivotable between an open position of the locking bracket in which the locking bracket can be arranged around the two adjacent bodies and a closed position in which the hoops together surround the region for receiving the two adjacent bodies, wherein each of the hoops forms a lug at their second ends that is substantially oriented perpendicular to the second end of the respective hoop and has at least one bore, and wherein the lugs of the hoops come to lie substantially in a planoparallel manner with respect to one another in the closed position so that the closing hoop of a padlock can be hung into the bores of the lugs for securing the hoops to one another.

For example, the hoops can be formed from steel plate, preferably from hardened steel plate, and can thus be formed in a comparatively solid manner, whereby the locking bracket cannot be manipulated and/or damaged or can only be manipulated and/or damaged to a small degree by the effect of mechanical force. Unlike conventional link chains, the locking bracket in accordance with the invention thus has a greater resistance with respect to the effect of mechanical force.

There is additionally the fact that the locking bracket in accordance with the invention also makes access to a padlock, and in particular to its closing hoop for securing the hoops of the locking bracket, more difficult since the lugs of the hoops of the locking bracket come to lie in a planoparallel manner and at a small spacing from one another in the closed position of the locking bracket so that the closing hoop of a padlock hung into the bore of the lugs is not accessible or is hardly accessible from the outside through the gap between the two lugs. The gap that is formed between the two lugs in the closed position of the locking bracket preferably has a clearance that is smaller than the thickness of the steel plate and is in particular preferably smaller than half the thickness of the steel plate from which the hoops are produced. The gap is thus so small that access to the hoop through the gap, for example using bolt cutters, a leverage tool, or a saw, is prevented. The two lugs can, however, also come to lie in a planoparallel manner directly next to one another in the closed position, i.e. without forming a gap therebetween, whereby the locking bracket offers even fewer points of attack for the effect of mechanical force. Furthermore, due to the orientation of the lugs, the locking bracket can be secured by means of a so-called disc lock, whereby the locking bracket or the lock can be operated from the front in a customary manner like the lock cylinder in a case. Furthermore, the locking bracket in accordance with the invention permits an installation at both sides since the bracket can be formed with mirror symmetry with respect to a plane that is oriented perpendicular to the joint axis of the bracket.

Preferred embodiments of the locking bracket in accordance with the invention will be described in the following, with further embodiments also being able to result from the description of the Figures, from the dependent claims, and from the drawings.

Provision is thus made in accordance with an embodiment that the respective hoop, including its lug, can be produced from one piece. The lug and the hoop are therefore not, for instance, two parts that can initially be handled separately and that are only connected to one another as part of production, for example by welding. Provision is rather made in accordance with the invention that the respective hoop, including its lug, can be made from one piece such as from one and the same sheet metal blank that is bent into shape to form the respective hoop together with its associated lug. There are therefore advantageously no abutment points or connection points between the lug and the hoop that as a rule represent easily manipulable weak points.

In accordance with a further embodiment, at least one of the lugs can form an angled end section. The angled end section can here advantageously be oriented perpendicular to the lug and thus extends substantially in parallel with the second end of the respective hoop since the lug is likewise oriented perpendicular to the second hoop end.

Provision can be made in accordance with a preferred embodiment that both lugs form an angled end section, with these end sections being oriented such that they project in mutually opposite directions from the respective lugs in the closed position of the locking bracket. The two angled end sections thus extend in a common alignment in the closed position of the locking bracket and thus cover a padlock hung into the lugs or into their bores, whereby unauthorized access thereto is made more difficult. The angled end sections thus represent effective protection for the closing hoop of a padlock since the angled end sections prevent access to the closing hoop of a padlock by means of bolt cutters.

This embodiment, in which each of the two lugs forms an angled end section, with these end sections being oriented such that they project in mutually opposite directions from the lugs in the closed position of the locking bracket, furthermore proves to be advantageous to the extent that an intermediate space is formed between the respective angled end section and the associated hoop, said intermediate space enabling a padlock or its closing hoop to be hung in the closed position of the locking bracket via the two lugs to secure the hoops of the locking bracket to one another in order thus to secure the closed position of the locking bracket. The two angled end sections of the lugs thus prevent a padlock hung via the two lugs in this manner from being able to be removed from the two lugs. If, therefore, for example, only one padlock is available in a specific situation whose closing hoop does not fit through the bores of the two lugs, this padlock can be hung via the two lugs in the closed position of the locking bracket in the previously described manner, with the two angled end sections preventing the padlock attached in this manner from being able to be removed from the two lugs. In other words, the closing hoop of a padlock hung via the two lugs in this manner is therefore captured in the intermediate space that is formed between the angled end section of each lug and the second end of the respective associated hoop.

In accordance with a further embodiment, the angled end section of at least one lug can, however, also be oriented such that it at least partly covers a free end of the respective other lug in the closed position of the locking bracket. For example, only one lug can have an angled end section, with this angled end section extending over the total height of the lug so that it covers the free end of the other lug over its total height in the closed position of the locking bracket.

In accordance with another embodiment, however, both lugs can also have one or more angled end sections that cover the free end of the respective other lug in the closed position of the locking bracket. The angled end sections of the one lug are preferably in engagement with the angled end sections of the other lug in this embodiment, for which purpose the angled end sections of the one lug have an offset with respect to the angled end section of the other lug. The angled end sections of the two lugs can thus preferably move into engagement with one another in a shape-matched manner in the sensor of a tongue and groove connection in the closed position of the locking bracket, whereby a possible gap between the two lugs is further increased in favor of an increase in the resistance of the locking bracket to external effect of force since the introduction of a leverage tool into the gap to lever open the locking bracket is made more difficult or is even made impossible.

In accordance with yet a further embodiment, the lug of a respective hoop can have a plurality of bores that are preferably of different sizes, with the respective bores of the hoops being aligned with one another in the closed position of the locking bracket. Different padlocks that can in particular have closing hoops of different lengths and/or different strengths can thus be used to secure the hoops to one another, with a plurality of padlocks also being able to be hung through the bores of the two lugs simultaneously as required in order thus to provide additional security.

FIGURES

An exemplary embodiment of a locking bracket in accordance with the invention will be explained in the following with reference to a single FIGURE, in which FIG. 1 shows a perspective representation of an exemplary embodiment of a locking bracket in accordance with the invention.

DESCRIPTION

FIG. 1 shows a perspective representation of an embodiment of a locking bracket 10 in accordance with the invention by which two mutually adjacent bodies such as a gate and a fence post (not shown) can be secured to one another. For this purpose, the locking bracket 10 has a first hoop 11 and a second hoop 12 that, together with the first hoop 11, surrounds a region 14 in its interior for receiving two adjacent bodies. In the embodiment shown here, the first hoop 11 has a substantially U-shaped first hoop section 21 and in a corresponding manner the second hoop 12 has a substantially U-shaped second hoop section 22 so that the first hoop section 21 forms, together with the second hoop section 22, a substantially oval or 0-shaped reception region 14 for two adjacent bodies that are to be secured to one another by the locking bracket 10.

The first hoop section 21 has a first end 23 and an oppositely disposed second end 25. In a corresponding manner, the second hoop section 22 also has a first end 24 and an oppositely disposed second end 26. The two hoops 11, 12 are connected to one another by means of a link joint 15 at their first ends 23, 24 so that they can be pivoted about the joint axis 16 between an open position (not shown) in which the two second ends 25, 26 of the two hoop sections 21, 22 are spaced further apart from one another than in FIG. 1 to be able to lay the locking bracket 10 around two mutually adjacent bodies and the closed position shown in FIG. 1 in which the two hoop sections 21, 22 cooperate to form the reception region 14 or to surround it.

As can furthermore be seen from FIG. 1, the first hoop 11 furthermore has a first lug 27 that is formed at the second end 25 of the first hoop section 21 and is oriented substantially perpendicular to the second end 25. The second hoop 12 in a corresponding manner also has a second lug 28 that is formed at the second end 26 of the second hoop section 22 and that is oriented substantially perpendicular to the second end 26. In the shown closed position of the locking bracket 10, the two lugs 27, 28 thus come to lie in a planoparallel manner next to one another, but with them being spaced apart from one another by a gap S of small size.

A passage bore 32 extends through the second lug 28 and a passage bore, which is not recognizable in FIG. 1, however, likewise extends in a corresponding manner through the first lug 27, with said second passage bore, however, being aligned in the closed position of the locking bracket 10 shown with the bore 32 in the second lug 28. A closing hoop of a padlock can thus be led through the bores in the two lugs 27, 28 to secure the two hoops 11, 12 to one another in order thus to secure the two hoops 11, 12 to one another with the aid of the padlock so that simultaneously two mutually adjacent bodies that are surrounded by the two hoop sections 21, 22 are directly secured to one another by the locking bracket 10.

In the embodiment shown, the first lug 27 forms a first angled end section 29 and the second lug 28 also forms a second angled end section 30 in a corresponding manner. In the embodiment shown here, the two end sections 29, 30 are oriented such that they project in mutually opposed directions from the two lugs 27, 28 in the closed position of the locking bracket 10 and thus extend in a common alignment. The first end section 29 is thus spaced apart from the first end 25 of the first hoop section 21 by the lug 27 and the second angled end section 30 is also spaced apart from the second end 26 of the second hoop section 22 in a corresponding manner by the second lug 28. A padlock or its closing hoop can thus, where required, also be hung via the two lugs 27, 28 for securing the two hoops 11, 12 to one another since a padlock hung in this manner at the locking bracket 10 via the two lugs 27, 28 is secured by the two angled end sections 29, 30.

Contrary to the embodiment shown, however, also only the first lug 27 can have an angled end section, however, that is oriented contrary to the embodiment shown such that it at least partly covers the free end of the second lug 28 in the closed position of the locking bracket 10. Although the gap S between the two lugs 27, 28 anyway offers hardly any engagement surface for a leverage tool or similar, the gap S is not accessible from the front in this embodiment in which the free end of the one lug 27, 28 is covered by the angled end section 30, 29 of the other lug 28, 27, whereby the locking bracket 10 in accordance with the invention can be manipulated even less.

An embodiment is furthermore also possible in which both the first lug 27 and the second lug 28 each form one or more angled end sections which are oriented such that they at least partly cover the free end of the respective other lug 28, 27. For this purpose, the end sections of the two lugs 27, 28 are formed offset from one another to be able to engage in a shape-matched manner into one another in the sense of a toothed arrangement or of a tongue in groove connection in the closed state of the locking bracket 10. The security against breaking open of the locking bracket 10 is increased even further by such an interlocking of the end sections of the two lugs 27, 28 since it can hereby be ensured that shear forces that can occur on an attempt to lever open the locking bracket 10 are not only taken up by the closing hoop of a padlock alone, but additionally also by the mutually interlocking end sections of the lugs 27, 28.

In the locking bracket 10 in accordance with the invention, the two hoops 11, 12, including the respective lugs 27, 28 and the angled end sections 29, 30 of the lugs 27, 28, are respectively produced from one piece. For example, each of the two hoops 11, 12 can be produced from a sheet metal blank in that the latter is bent into shape to form the respective hoop section 21, 22, the respective lug 27, 28, and the end sections 29, 30. Each of the two hoops 11, 12 is thus produced from one piece and is not, for instance, composed of individual components that are, for example, fastened to one another by welding.

As can further be seen from FIG. 1, the locking bracket 10 in accordance with the invention is symmetrical to a plane that extends perpendicular to the joint axis 16 of the joint 15. Due to the symmetrical design of the locking bracket 10, the latter can be used in different orientations in order, for example, to secure a gate to a fence post, with it being ensured in any orientation that a padlock hung through the bores of the lugs 27, 28 hangs downward in the desired manner. The locking bracket 10 is thus intuitively usable since the user has the possibility to attach the locking bracket 10 exactly to two bodies to be secured to one another such as the conditions on site allow.

Contrary to the embodiment shown, the lug 27, 28 of each hoop 11, 12 can also have a plurality of bores that can also be of different sizes as required. Not only padlocks having closing hoops of different lengths or strengths can hereby be used; a plurality of padlocks can rather also be hung simultaneously through the bores of the lugs 27, 28 as required to thus further increase the security against breaking open of the locking bracket as required.

In the embodiment shown, the two hoops 11, 12 or their hoop sections 21, 22 furthermore have bores 33, 34 through which the locking bracket 10 can, for example, be screwed to a fence post.

REFERENCE NUMERAL LIST

10 locking bracket
11 first hoop
12 second hoop
14 reception region
15 joint
16 joint axis
21 first hoop section
22 second hoop section
23 first end
24 first end
25 second end
26 second end
27 first lug
28 second lug
29 first angled end section
30 second angled end section
32 bore
33 bore
34 bore
S gap

The invention claimed is:

1. A locking bracket for securing two adjacent bodies to one another, the locking bracket having a first hoop and a second hoop that, together with the first hoop, surrounds a region for receiving the two adjacent bodies, wherein the first and second hoops respectively have a first end and a second end, wherein the first and second hoops are connected to one another in an articulated manner at their first ends so that the hoops can be pivoted about an axis between an open position in which the locking bracket can be arranged around the two adjacent bodies and a closed position in which the first and second hoops together surround the region for receiving the two adjacent bodies, wherein each of the first and second hoops forms a lug at their second ends, said lug being oriented substantially perpendicular to the second end and having at least one bore, and wherein the lugs of the first and second hoops come to lie in a planoparallel manner with respect to one another in the closed position so that a closing hoop of a padlock can be introduced into the bores of the lugs to secure the first and second hoops to one another, wherein each of the lugs forms an angled end section, the locking bracket being mirror-symmetric with respect to a plane extending perpendicularly to the axis about which the hoops can be pivoted.

2. The locking bracket in accordance with claim 1, wherein the locking bracket is configured to secure a gate to a fence post.

3. The locking bracket in accordance with claim 1, wherein the respective one of the first and second hoop, including its lug, is produced from one piece.

4. The locking bracket in accordance with claim 3, wherein the respective one of the first and second hoop, including its lug, is produced from one and the same sheet metal blank.

5. The locking bracket in accordance with claim 1, wherein the angled end sections project in mutually opposite directions therefrom in the closed position of the locking bracket.

6. The locking bracket in accordance with claim 1, wherein the angled end section of one lug at least partly covers a free end of the other lug in the closed position of the locking bracket.

7. The locking bracket in accordance with claim 6, wherein the angled end sections respectively form a toothed arrangement having at least one tooth, with the at least one tooth of the lugs being in engagement with one another in the closed position of the locking bracket.

8. The locking bracket in accordance with claim 1, wherein the lug of each of the first and second hoop has a plurality of bores, with the respective bores of the first and second hoops being aligned with one another in the closed position of the locking bracket.

9. The locking bracket in accordance with claim 8, wherein the plurality of bores of the lug are of different sizes.

* * * * *